US006679795B2

(12) United States Patent
Ouimette et al.

(10) Patent No.: US 6,679,795 B2
(45) Date of Patent: Jan. 20, 2004

(54) TARGET APPARATUS AND METHOD

(76) Inventors: Aaron D. Ouimette, 5 Anna Ct., Hilton Head Island, SC (US) 29926; Donald G. Ouimette, 5 Anna Ct., Hilton Head Island, SC (US) 29926

( * ) Notice: Subject to any disclaimer, the term of this patent is extended or adjusted under 35 U.S.C. 154(b) by 68 days.

(21) Appl. No.: 09/920,211

(22) Filed: Aug. 1, 2001

(65) Prior Publication Data

US 2002/0183141 A1 Dec. 5, 2002

Related U.S. Application Data

(60) Provisional application No. 60/295,673, filed on Jun. 4, 2001.

(51) Int. Cl.[7] ..... A63B 69/00

(52) U.S. Cl. ..... 473/439; 280/47.24

(58) Field of Search ..... 473/439, 422, 473/451, 456, 454; 280/47.24, 47.26, 79.2, 47.34

(56) References Cited

U.S. PATENT DOCUMENTS

| | | | | | |
|---|---|---|---|---|---|
| 1,567,384 | A | | 12/1925 | Rectenwald et al. | |
| 2,915,314 | A | | 12/1959 | Phillips | |
| 3,039,770 | A | * | 6/1962 | Ferretti | 473/454 |
| 3,197,208 | A | | 7/1965 | Makar | |
| 3,591,194 | A | * | 7/1971 | Vega | 280/79.2 |
| 3,633,909 | A | | 1/1972 | Doynow | |
| 3,647,214 | A | * | 3/1972 | Hohmann | 273/392 |
| 4,083,559 | A | | 4/1978 | Owen, Jr. | |
| 4,383,686 | A | * | 5/1983 | Cardieri | 473/417 |
| 4,635,956 | A | * | 1/1987 | Morrissette | 280/652 |
| 4,790,559 | A | * | 12/1988 | Edmonds | 280/655 |
| 4,873,841 | A | * | 10/1989 | Bradshaw et al. | 62/239 |
| 4,976,448 | A | * | 12/1990 | Wickersham et al. | 280/47.2 |
| 5,123,187 | A | * | 6/1992 | Zamaria | 37/265 |
| 5,228,706 | A | * | 7/1993 | Boville | 280/43.22 |
| 5,261,681 | A | * | 11/1993 | Goldmeier | 280/87.01 |
| 5,271,616 | A | | 12/1993 | Grimaldi | |
| 5,313,817 | A | * | 5/1994 | Meinders | 62/457.1 |
| 5,320,343 | A | * | 6/1994 | McKinney | 473/417 |
| 5,803,842 | A | | 9/1998 | Ross | |
| 5,853,180 | A | * | 12/1998 | Taylor | 280/32.6 |
| 6,311,991 | B1 | * | 11/2001 | Conrado et al. | 280/47.26 |
| 6,328,320 | B1 | * | 12/2001 | Walski et al. | 280/47.26 |
| 6,398,215 | B1 | * | 6/2002 | Carroll | 273/108 |
| 6,398,672 | B1 | * | 6/2002 | Olson | 473/439 |
| 6,446,988 | B1 | * | 9/2002 | Kho | 280/47.26 |
| 6,454,293 | B1 | * | 9/2002 | Anderson | 280/651 |

* cited by examiner

*Primary Examiner*—Paul T. Sewell
*Assistant Examiner*—Nini F. Legesse
(74) *Attorney, Agent, or Firm*—Gardner Groff, P.C.

(57) ABSTRACT

A target for an object thrown, struck or otherwise projected by a user. The target includes a number of uprights pivotally mounted to a base. A user projects an object at the uprights in an attempt to knock them down. The target optionally includes a reset mechanism for remotely raising the uprights back into their raised position after they have been knocked down, and a storage bin for storing and transporting equipment.

18 Claims, 2 Drawing Sheets

TARGET APPARATUS AND METHOD

CROSS-REFERENCE TO RELATED APPLICATION

This application claims the benefit of U.S. Provisional Patent Application Ser. No. 60/295,673, filed Jun. 4, 2001, which application is incorporated herein by reference.

FIELD OF THE INVENTION

The present invention relates to sporting goods, and more particularly to a portable target for baseball or softball pitchers, or for other athletes to practice accuracy and velocity in throwing or otherwise projecting a ball or other object.

BACKGROUND OF THE INVENTION

In order to improve their accuracy and velocity, baseball and softball pitchers often practice by throwing a ball at a target. Football quarterbacks, tennis players and other athletes also practice by throwing or hitting a ball or otherwise projecting an object at a target. The target may be relatively simple, such as a tire hung by a rope from a tree; or relatively complex, such as a simulated pitcher's mound and home plate with radar speed measurement.

Although previously known targets are often adequate for certain specified applications, many have been found less than ideal for other applications. For example, it has been found that a target that is portable and relatively simple in construction and operation is advantageous for uses requiring that the device be transported to and from a practice site on a frequent basis. It has also been found desirable that a pitching target provide feedback, visual or otherwise, to confirm that the target was hit and/or to allow two or more users to engage in a contest of skill. It would also be advantageous if a pitching target were capable of storing and facilitating transport of practice gear and other equipment.

Thus it can be seen that needs exist for an improved method and target apparatus for throwing, striking or otherwise projecting an object at a target. It is to the provision of a target apparatus and method meeting these and other needs that the present invention is primarily directed.

SUMMARY OF THE INVENTION

The present invention is a target for permitting a person to practice accuracy and velocity in projecting an object, such as when throwing a baseball, softball, football or other object, or when striking a tennis ball, hockey puck or other object. The invention is described herein with reference to use as a pitching target for throwing a baseball. It will be understood, however, that the invention is readily adapted for use as a target for any of a variety of objects thrown, struck or otherwise projected by a user.

The target apparatus of the present invention provides practice and/or entertainment for one or more users. A practice regimen utilizing the target apparatus of the present invention allows a user to improve his or her skills, including accuracy and velocity in throwing, striking or otherwise projecting an object. The target apparatus of the present invention is also suited for use in various contests of skill between two or more participants. For example, two or more participants can compete with one another to test their accuracy, endurance and/or consistency.

In preferred forms, the target apparatus of the present invention is readily portable, so that a user can transport the device to and from a practice site with ease. In other forms, the device can be permanently or removably mounted in a fixed position for repeated use. Preferred and example forms of the target apparatus are capable of storing and facilitating transport of practice gear and other equipment, and protecting the equipment from theft, loss or damage by the elements.

In one aspect, the invention is a target apparatus preferably including a base having a first end and a second end, the first end of the base comprising a handle, and the second end of the base having at least one wheel rotationally mounted thereto. The target preferably also includes a storage bin mounted to the base, the storage bin defining an interior space for containing equipment and an opening providing access into the interior space. The target preferably also includes at least one upright pivotally mounted to the base and movable between a raised position wherein the at least one upright is generally vertical and a lowered position wherein the at least one upright covers at least a portion of the opening of the storage bin.

In another aspect, the invention is a target apparatus comprising a base, and at least one upright pivotally mounted to the base and movable between a raised position and a lowered position.

In yet another aspect, the invention is a method for practicing accuracy in projecting an object. The method preferably includes: providing a target having a base and at least one upright pivotally mounted to the base; raising the at least one upright to a raised position; and projecting an object at the at least one upright in an attempt to knock the upright from the raised position to a lowered position.

These and other objects, features and advantages of preferred forms of the present invention are described in greater detail herein with reference to example embodiments.

BRIEF DESCRIPTION OF THE DRAWING FIGURES

DETAILED DESCRIPTION OF PREFERRED EMBODIMENTS

Figure 1:
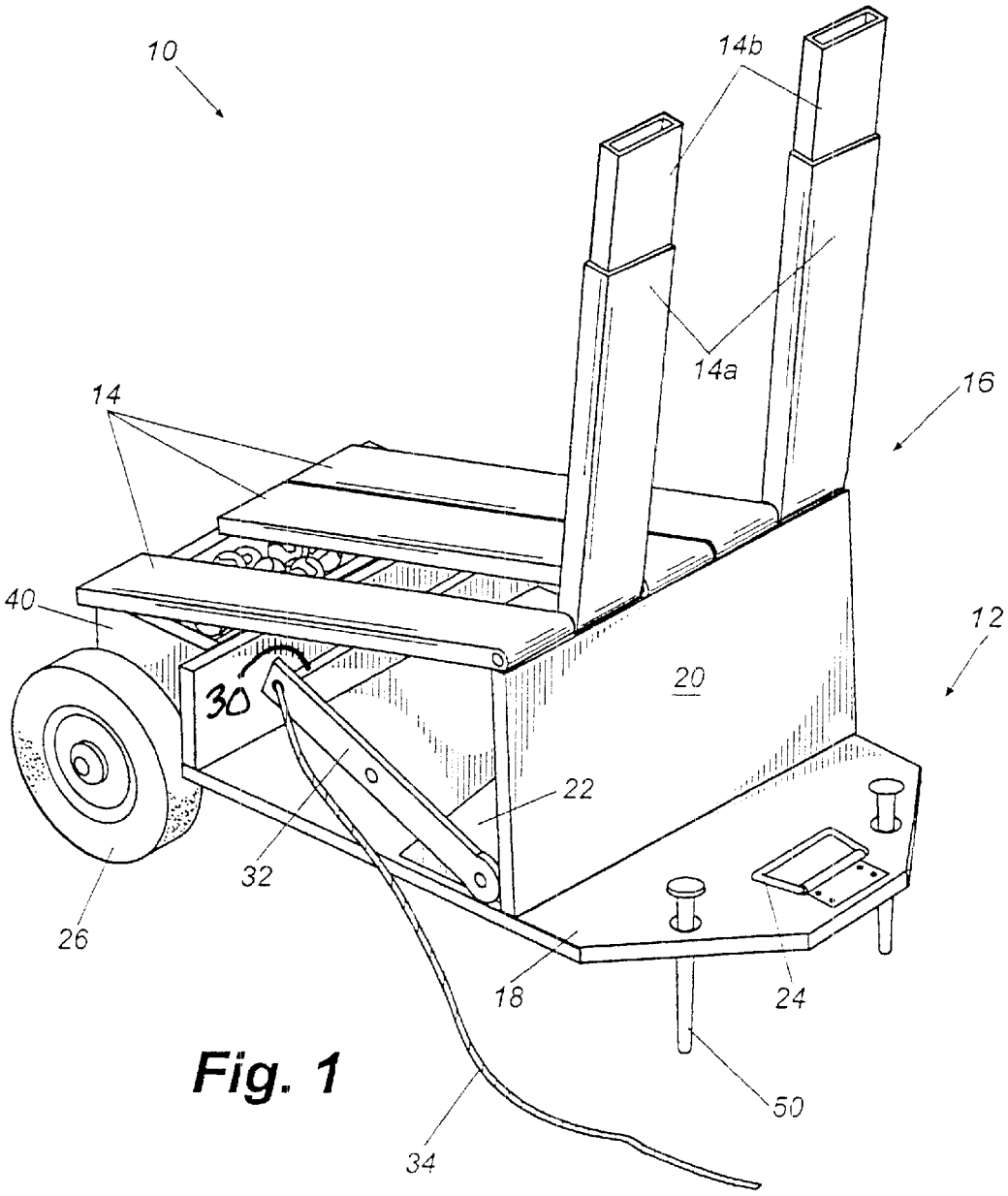
FIG. 1 shows a perspective view of a target apparatus according to a preferred form of the present invention.

Referring now to the drawing figures, wherein like reference numerals represent like parts throughout, preferred forms of the present invention will now be described. As will be understood best with reference to FIGS. 1 and 2, one aspect of the present invention is a target 10 preferably comprising a base 12 and one or more uprights 14. The uprights 14 are preferably pivotally connected to the base by one or more hinges, pivot pins or other pivotal connection means 16. The base 12 and uprights 14 are preferably fabricated from wood, aluminum, plastics, and/or other materials providing sufficient support and impact resistance.

The base 12 preferably comprises a generally horizontal panel 18 having a forward end, a rear end, first and second sides, and upper and lower faces. In an example embodiment, the panel 18 has an end-to-end length of about 31" and a side-to-side width of about 20", and is fabricated from ¾" plywood. The sides of panel 18 are optionally notched adjacent the rear end to accommodate wheels for rolling the target without the wheels projecting beyond the sides of the base. The sides of panel 18 may also be mitered at the forward end for convenience in moving the target. The base 12 optionally further comprises a generally vertical panel 20, mounted generally perpendicularly to the upper face of the horizontal panel 18. In a preferred embodiment, the height of the vertical panel 20 is selected to result in the pivot connection 16 being located a distance above the ground corresponding to the lower boundary of a strike zone of a baseball batter. For example, the vertical panel 20 may have a height of about 8" to about 18", whereby the pivot connection 16 (and thus, the lower end of the uprights 14) is about knee-high for an imaginary batter. Of course, the actual dimensions of this and other portions of the target 10 may vary depending upon the age and size of the intended user, the height of the wheels or other base support structure, the sport being practiced, and other factors. Two or more interchangeable panels 20, or an adjustable-height panel 20 are optionally provided to allow the target 10 to be adapted to different conditions and uses. The vertical panel 20 preferably has a width approximately equal to or somewhat less than the width of the horizontal panel 18. Most preferably, the panel 20 has a width about equal to the desired target area width. In an example embodiment, the vertical panel has a width of about 20", a height of about 9 ½", and is fabricated from ¾" plywood. The vertical panel 20 is preferably affixed to the horizontal panel 18 by screws, adhesive, and/or other attachment means. One or more corner braces 22 are preferably provided between the horizontal panel 18 and the vertical panel 20 for structural integrity.

Figure 2:
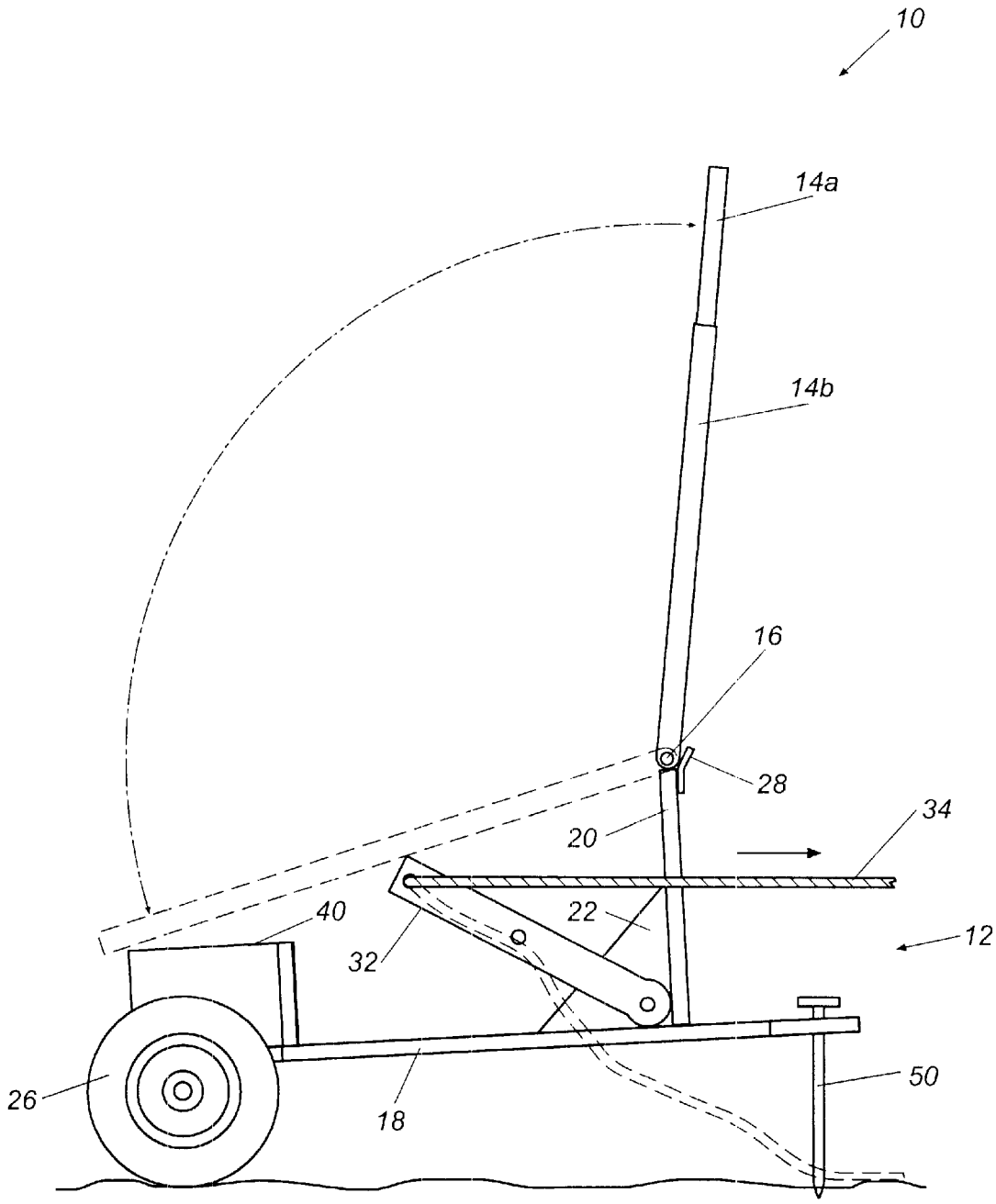
FIG. 2 shows a side elevational view of the target apparatus shown in FIG. 1.

One or more handles 24 is/are preferably affixed to or integrally formed with the base 12 to facilitate moving the target 10. For example, the handle(s) 24 can comprise one or more cutouts or recesses formed in the material of the base, and/or can comprise one or more prefabricated handles as depicted in FIG. 1. In alternate embodiments, a trailer hitch or other transport coupling means are provided on the base 12 or elsewhere on the target 10 for assisting in moving the target. One or more wheels 26 are preferably rotationally carried on an axle mounted to the base 12 to permit the target to be rolled. In an example embodiment, two rubber wheels 26 of approximately 8" diameter are provided. The handle and the wheel(s) are preferably mounted at or adjacent opposite ends of the base 12 for ease of transport. For example, in the depicted embodiment, two wheels are mounted adjacent the rear end of the base, one along each side, and a handle is provided adjacent the forward end of the base. The handle 24 and wheels 26 render the target 10 portable, and permit the target to serve double-duty as an equipment caddy. Equipment such as balls, bats, gloves, catcher's gear, etc., can be loaded onto the base 12, and the target 10 pulled by the handle 24 as a cart. In alternate embodiments, the handle 24 and wheels 26 are omitted, and the target 10 is permanently mounted in place at a practice site.

One or more uprights 14 are pivotally attached to the base 12 by a hinge or other pivotal connection means 16. Although the depicted embodiment comprises five uprights 14, a target comprising more or fewer uprights is within the scope of the invention. The one or more uprights 14 are preferably pivotally mounted at their lower end to the top of the vertical panel 20. Alternatively, the vertical panel 20 is omitted and the one or more uprights 14 are pivotally mounted to the horizontal panel 18. Each upright 14 is preferably pivotally connected to the base 12 by a hinge, or is mounted to an axle or rod affixed to the base. Alternatively, the uprights 14 are carried on an axle comprising an acme screw with clips to allow the user to change the width of the target surface. In an example embodiment of the invention, the uprights 14 have a length selected to correspond with the height of a baseball strike zone of a batter, or to the height of another predetermined simulated target object. For example, the uprights 14 preferably have a length of about 16" to about 36", and more preferably about 20"–25", for simulated youth or adult batters of average size. In one embodiment of the invention, the uprights 14 are fabricated from wood, such as for example, 1"×4" or 1"×6" nominal lumber. Each upright 14 is movable between a raised or upright position (shown in solid lines in FIG. 2) and a lowered is position (shown in broken lines). The uprights 14 preferably traverse an arc of about 90° or slightly more between their raised and lowered positions, the raised position being generally vertical or just beyond vertical as shown, and the lowered position being generally horizontal or just beyond horizontal as shown. A stop 28 is preferably mounted to or integrally formed with the base 12 for contacting and retaining the uprights 14 in their raised positions. Alternatively, the hinge or pivot means 16 comprises an integral stop that prevents motion beyond the raised position.

In a further preferred embodiment, one or more of the uprights 14 allow adjustment of the target height. A first upright member 14*a* is pivotally connected to the base 12, and a second upright member 14*b* is slidingly engaged with the first upright member. For example, as shown in the figures, each upright comprises two generally hollow aluminum extrusions, wherein an inner upright member 14*b* is telescopically slidable within an outer upright member 14*a*. Alternatively, each upright comprises first and second upright members having interengaging surface features to permit longitudinal sliding motion therebetween. Third and further upright members (unshown) are optionally slidingly engaged with the second and subsequent members respectively to provide further degrees of adjustment. A friction fit or locking mechanism can be provided to releasably fix the relative positions of the first and second upright members 14*a*, 14*b*. The first and second upright members are slidable relative to one another between an extended position corresponding to a maximum target height and a retracted position corresponding to a minimum target height. In this manner, the user can selectively adjust the height of the uprights 14, to simulate the strike zone of a taller or shorter batter, as desired. The first upright member 14*a* preferably has a length equal to or slightly less than the minimum desired target height or strike zone, and the second upright member 14*b* (and third and subsequent upright members, if present) preferably is extendable beyond the first upright member a distance equal to or slightly greater than the difference between the maximum and minimum target heights. In alternate embodiments, two or more interchangeable sets of uprights 14, each set having a different upright length, are provided to allow for adjustment of the target height.

The target 10 optionally further comprises a reset means for raising the uprights 14 back into their raised position after they have been knocked down. In a preferred embodiment, the reset means comprises a reset bar 30 extending at least partially across the width of the base 12 for contacting the uprights 14 to raise them into their raised positions. The reset means preferably further comprises one or more pivot arms 32, each having a first end pivotally mounted to the base 12 and a second end carrying the reset bar 30 along an arcuate path in contact with the uprights 14 and traversing their raised and lowered positions. A rope 34 is preferably connected to the pivot arm to permit remote actuation of the reset means. In alternate embodiments, the reset means comprises a remote control, such as a wireless infrared or radio frequency remote control operator, which communicates with a receiver to actuate a motor-driven, electromagnetic, or other form of powered reset mechanism. In an alternate embodiment, the uprights 14 are spring-loaded, as with a torsion or tension spring engaged between the base 12 and the uprights, to raise or assist in raising the uprights 14 to their raised position.

In further preferred embodiments, the target 10 optionally comprises a storage bin 40 for storing balls or other items to be thrown or otherwise used in connection with the target. The bin 40 preferably comprises a generally rectangular box structure defining an interior space and having an open top providing access to the interior space. The storage bin 40 is preferably mounted on the base 12, most preferably between the two wheels 26 so that the weight of objects contained therein bears substantially directly over the wheels, minimizing the effort necessary to lift the forward end of the target for transport. This location of the bin 40 provides further advantage, as the uprights 14 function as a built-in cover for the bin when placed in their lowered position (as shown in broken lines in FIG. 2), thereby protecting the bin's contents from loss, theft and/or damage by the elements. The lowered uprights 14 preferably cover at least a portion of the opening to the bin 40, and more preferably cover substantially all of the opening to the bin. A latch or other locking means is optionally provided for securing the uprights 14 in their lowered position to prevent unauthorized access to the contents of the bin 40. The bin 40 optionally comprises a weather-proof liner for protecting the contents of the bin, insulated walls permitting the bin to function as a food and beverage cooler, a hinged or removable cover over the top opening, and/or a drawstring or elastic opening bag to secure the bin's contents.

The target 10 optionally further comprises a braking system for holding the target in a fixed position and resisting movement that otherwise might result from the target being struck with pitched balls or other objects. For example, one or more stakes 50 engage the base 12, whereby the user may drive the stakes into the ground by stepping on them to fix the target 10 in position. The stakes 50 preferably comprise an expanded bearing surface for allowing the user to apply pressure to drive the stake into the ground and to withdraw the stake to release the braking system. The stakes 50 are preferably driven through an opening formed in the base 12, pivotally mounted to the base 12, or otherwise engaged with the target 10. The stakes 50 are preferably captive within their openings, or otherwise tethered to the target 10 to prevent loss. Alternatively, the braking system comprises one or more projections or cleats affixed to or integrally formed with the lower surface of the base 12 for engaging the ground. The stakes 50, cleats, or other braking elements are preferably positioned adjacent the forward end of the base 12, whereby raising the forward end by lifting the handle 24 automatically disengages the braking elements from the ground. The length of the stakes 50, cleats, or other braking elements are preferably selected to position the panel 18 of the base 12 in a generally horizontal orientation when the braking system is engaged. In an example embodiment, stakes 50 have a length at least equal to the radius of the wheels 26, and preferably 1½–2 times the radius of the wheels.

The target 10 optionally further comprises feedback means for signaling and/or recording the results of a practice session. In an example embodiment, the target 10 comprises an electronic recorded or simulated voice system and/or an electronic scoring system operatively coupled to sensors on or adjacent the uprights 14, to provide audio and/or visual feedback to the user when the uprights are knocked over. A scoreboard can be operatively coupled to the target 10 for keeping count of strikes and balls thrown, or otherwise keeping score for one user or two or more users engaged in a contest. Graphics in the form of stickers, Velcro attachments, or printed matter can be applied to one or more of the uprights 14 as added targets or for scoring purposes. For example, the forward face of the base 12 and the uprights 14 optionally comprise an image of a baseball catcher, umpire, and/or batter's box area; a football receiver; or other simulated target image. Velcro or other detachable means can be provided for affixing a target object to one or more selected upright(s), and permitting a user to selectively move the target object to vary its position. External surfaces of the target 10 optionally bear visible indicia, such as trademarks or logos of the manufacturer, advertising, informational text or graphics, decorative features, etc. The invention optionally further comprises a target 10, substantially as described above, in combination with one or more of the following: a portable pitching mound, athletic attire such as shirts and/or hats, a video or DVD advertising to or instructing users or potential users of the target; one or more balls for throwing at the target, a backstop net or tarp for stopping and collecting pitched balls, and/or a ball collection and return mechanism.

The invention optionally further comprises a simulated batter, such as a silhouette formed of plywood, plastic, etc., optionally having graphic images applied thereto, attached to or adapted to be placed adjacent to the target 10 for increased realism. In further optional forms, the simulated batter may be mechanized, such as with a motor-driven articulation mechanism, causing the simulated batter to swing a bat. Motion or proximity sensors may be included to cause the simulated batter to initiate a swing upon sensing motion of the pitcher or of a pitched ball, or upon sensing the proximity of a pitched ball.

In use, the target 10 is positioned in the desired location, and the braking system is actuated to secure the target in position. For example, one or more stakes 50 attached to the base 12 of the target 10 are driven into the ground beneath or adjacent the target position. One or more of the uprights 14 of the target 10 are placed in their raised position (as shown in solid lines in FIG. 2). The user then throws a baseball or other object at the uprights 14, attempting to knock the uprights down. A user can keep score of successful throws which knock an upright down in order to monitor his or her development through one or more practice sessions, and/or multiple users can keep score in a contest of skill. After all of the uprights have been knocked down, or after a given number of throws, the reset mechanism is actuated to return the upright members 14 to their raised position for further use. When use of the device is complete, the upright members 14 are lowered to their lowered position (as shown in broken lines in FIG. 2), and the braking mechanism is released. The pitching target 10 is then ready for transport by grasping the handle 24 and pulling to roll the device along its wheels 26. Balls or other items used in connection with the target 10 can be stored in the storage bin 40.

The above description and appended drawings are representative of example embodiments of the present invention. The full spirit and scope of the invention, however, is not limited to any particular embodiment or embodiments. Thus, it will be readily apparent to those of ordinary skill in the art that many additions, modifications and deletions can be made to the described embodiments without departing from the spirit and scope of the invention.

What is claimed is:

1. A target apparatus comprising:

a base;

a storage bin mounted to said base, said storage bin defining an interior space for containing equipment and an opening providing access into the interior space; and a plurality of uprights arranged alongside one another, each upright being pivotally mounted to said base and separately movable between a raised position wherein said upright is generally vertical and a lowered position wherein said upright covers a portion of the opening of said storage bin, wherein each upright comprises a first portion coupled to said base, and a second portion slidingly engaged with said first portion to provide height adjustment of said upright.

2. The target apparatus of claim 1, wherein said plurality of uprights cover substantially all of the opening of said storage bin in their lowered positions.

3. The target apparatus of claim 1, wherein the base has a first end comprising a handle and a second end having at least one wheel rotationally mounted thereto.

4. A target apparatus comprising:

a base;

a storage bin mounted to said base, said storage bin defining an interior space for containing equipment and an opening providing access into the interior space;

a plurality of uprights arranged alongside one another, each upright being pivotally mounted to said base and separately movable between a raised position wherein said upright is generally vertical and a lowered position wherein said upright covers a portion of the opening of said storage bin; and at least one stake for anchoring said base relative to a ground surface.

5. A target apparatus comprising:

a base;

a storage bin mounted to said base, said storage bin defining an interior space for containing equipment and an opening providing access into the interior space;

a plurality of uprights arranged alongside one another, each upright being pivotally mounted to said base and separately movable between a raised position wherein said upright is generally vertical and a lowered position wherein said upright covers a portion of the opening of said storage bin; and means for resetting said plurality of uprights from the lowered position to the raised position.

6. The target apparatus of claim 5, wherein said means for resetting said plurality of uprights comprises a reset bar pivotally mounted to said base.

7. The target apparatus of claim 6, wherein said means for resetting said plurality of uprights further comprises a rope having a first end attached to said reset bar.

8. A target apparatus comprising a base and a plurality of uprights arranged alongside one another, each upright being pivotally mounted to said base and separately movable between a raised position and a lowered position, and wherein each upright comprises a first portion coupled to said base, and a second portion slidingly engaged with said first portion to provide height adjustment of said upright.

9. The target apparatus of claim 8, wherein said base comprises at least two wheels rotationally mounted thereto.

10. The target apparatus of claim 8, further comprising a storage bin mounted to an upper surface of said base.

11. The target apparatus of claim 10, wherein each upright covers a portion of said storage bin in its lowered position.

12. The target apparatus of claim 8, further comprising a storage bin mounted to said base, said storage bin defining an interior space for containing equipment and an opening providing access into the interior space, and wherein said plurality of uprights cover substantially all of the opening of said storage bin in their lowered positions.

13. The target apparatus of claim 8, further comprising at least one stake for anchoring said base relative to a ground surface.

14. The target apparatus of claim 8, further comprising means for resetting the plurality of uprights.

15. The target apparatus of claim 14, wherein said means for resetting the plurality of uprights comprises a reset bar pivotally mounted to said base.

16. The target apparatus of claim 15, further comprising a rope having a first end attached to said reset bar.

17. A target apparatus comprising:

a base having a storage bin mounted thereto;

a plurality of uprights pivotally mounted to said base, each of the plurality of uprights being separately moveable between a substantially vertical position and a substantially horizontal position, wherein the uprights cover the storage bin when in the substantially horizontal position; and a reset bar pivotally mounted to said base for raising the plurality of uprights from the substantially horizontal position to the substantially vertical position.

18. The target apparatus of claim 17, wherein each of the plurality of uprights comprises a first portion pivotally coupled to said base, and a second portion telescopingly engaged with said first portion to provide height adjustment of said upright.

* * * * *